US011308769B2

(12) United States Patent
Thompson

(10) Patent No.: US 11,308,769 B2
(45) **Date of Patent: *Apr. 19, 2022**

(54) ELECTRONIC GAMING MACHINE AND METHOD FOR PROVIDING A FLIP-IT WAGERING GAME

(71) Applicant: Flip-It The Holding Company, LLC, Las Vegas, NV (US)

(72) Inventor: Tamra A. Thompson, Las Vegas, NV (US)

(73) Assignee: Flip-It The Holding Company, LLC, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/074,329

(22) Filed: Oct. 19, 2020

(65) Prior Publication Data

US 2021/0104132 A1 Apr. 8, 2021

Related U.S. Application Data

(63) Continuation of application No. 15/800,379, filed on Nov. 1, 2017, now Pat. No. 10,810,842.

(60) Provisional application No. 62/417,901, filed on Nov. 4, 2016.

(51) Int. Cl.
*G07F 17/32* (2006.01)

(52) U.S. Cl.
CPC ..... *G07F 17/3293* (2013.01); *G07F 17/3288* (2013.01); *G07F 17/322* (2013.01); *G07F 17/3209* (2013.01); *G07F 17/3244* (2013.01); *G07F 17/3246* (2013.01); *G07F 17/3258* (2013.01)

(58) Field of Classification Search
USPC ..... 463/11, 12, 13
See application file for complete search history.

(56) References Cited

U.S. PATENT DOCUMENTS

2012/0108337 A1* 5/2012 Kelly ..... G07F 17/3209 463/37
2015/0199880 A1* 7/2015 Brown ..... G07F 17/3216 463/11
2016/0019748 A1* 1/2016 LeMay ..... G07F 17/3227 463/20
2016/0155291 A1* 6/2016 Brown ..... G07F 17/3227 463/13
2016/0196722 A1* 7/2016 Davis ..... G07F 17/3239 463/25
2017/0028295 A1* 2/2017 Patton ..... G07F 17/32
2018/0047255 A1* 2/2018 Yee ..... G07F 17/3293
2018/0158287 A1* 6/2018 Yoseloff ..... G07F 17/3267
(Continued)

*Primary Examiner* — Pierre E Elisca
(74) *Attorney, Agent, or Firm* — Howard & Howard Attorneys PLLC

(57) ABSTRACT

An electronic gaming machine, a system, and a method provide a wagering game to a player. Four community cards are dealt to a community area of a table. The player enters a wager associated with an expected characteristic of a fifth community card to be dealt during the game. The fifth community card is dealt and a determination is made whether the player wins the wager based on the actual characteristic of the fifth community card matching the expected characteristic associated with the player's wager. An award to be received by the player is determined based on the player winning the wager.

20 Claims, 6 Drawing Sheets

(56) References Cited

U.S. PATENT DOCUMENTS

2018/0225928 A1* 8/2018 Snow ..... G07F 17/3293
2019/0385416 A1* 12/2019 Snow ..... G07F 17/3225

* cited by examiner

ELECTRONIC GAMING MACHINE AND METHOD FOR PROVIDING A FLIP-IT WAGERING GAME

CROSS-REFERENCE TO RELATED APPLICATIONS

The present application is a continuation to U.S. patent application Ser. No. 15/800,379, filed Nov. 1, 2017, which claims priority to U.S. Provisional Patent Application Ser. No. 62/417,901, filed Nov. 4, 2016, both disclosures of which are hereby incorporated by reference in their entirety for all purposes.

FIELD OF THE DISCLOSURE

The present disclosure relates generally to wagering games, and more specifically, to an electronic gaming machine and a method for providing a Flip-It wagering game.

BACKGROUND

A variety of card games have been developed over the years, such as poker and blackjack. One popular poker game is Texas Hold 'Em poker. In Texas Hold 'Em poker, one or more standard 52 card poker decks are shuffled by a dealer and dealt to two or more players. In addition, a series of community cards are dealt in stages to a common location on a poker table. The community cards are usable by all players to form a hand in conjunction with the cards dealt to each individual player. However, some players may feel that Texas Hold 'Em and similar card games require complicated strategies and are not suitable for casual players or novices. In addition, players often get bored with games that have been played the same way for years and desire new, fresh games that add excitement to their gameplay.

The present disclosure is aimed at solving one or more of the problems identified above.

SUMMARY

In one embodiment, an electronic gaming machine includes a wager input device that accepts a physical item associated with a monetary value and a player input device configured to receive an input representative of a wager amount from a player operating the electronic gaming machine, wherein the monetary value is added to a credit balance associated with the player and the wager amount is deducted from the credit balance. The electronic gaming machine also includes a display device, a processor, and a cash out device configured to dispense at least a portion of the credit balance in the form of a physical object. The processor is configured to provide a wagering game to the player, wherein the wagering game includes a virtual table displayed on the display device. The processor is also configured to deal four community cards to a community area of the virtual table, and receive an input associated with a wager entered by the player, the wager being associated with an expected characteristic of a fifth community card to be dealt during the game. The processor is further configured to deal the fifth community card, determine whether the player wins the wager based on the actual characteristic of the fifth community card matching the expected characteristic associated with the player's wager, and determine an award to be received by the player based on the player winning the wager. The processor is still further configured to add the award to the credit balance of the player, receive an input from the player to initiate a cash out operation, and cause the cash out device to dispense at least a portion of the credit balance in the form of a physical object.

In another embodiment, a method of providing a wagering game to a player includes dealing four community cards to a community area of a table, receiving a wager from a player, the wager being associated with an expected characteristic of a fifth community card to be dealt during the wagering game, and dealing the fifth community card. The method also includes determining whether the player wins the wager based on the actual characteristic of the fifth community card matching the expected characteristic associated with the player's wager, and determining an award to be received by the player based on the player winning the wager.

BRIEF DESCRIPTION OF THE DRAWINGS

Advantages of the present disclosure will be readily appreciated, as the same becomes better understood by reference to the following detailed description, when considered in connection with the accompanying drawings. Non-limiting and non-exhaustive embodiments of the present disclosure are described with reference to the following figures, wherein like numerals refer to like parts throughout the various views unless otherwise specified.

DETAILED DESCRIPTION

Figure 1:
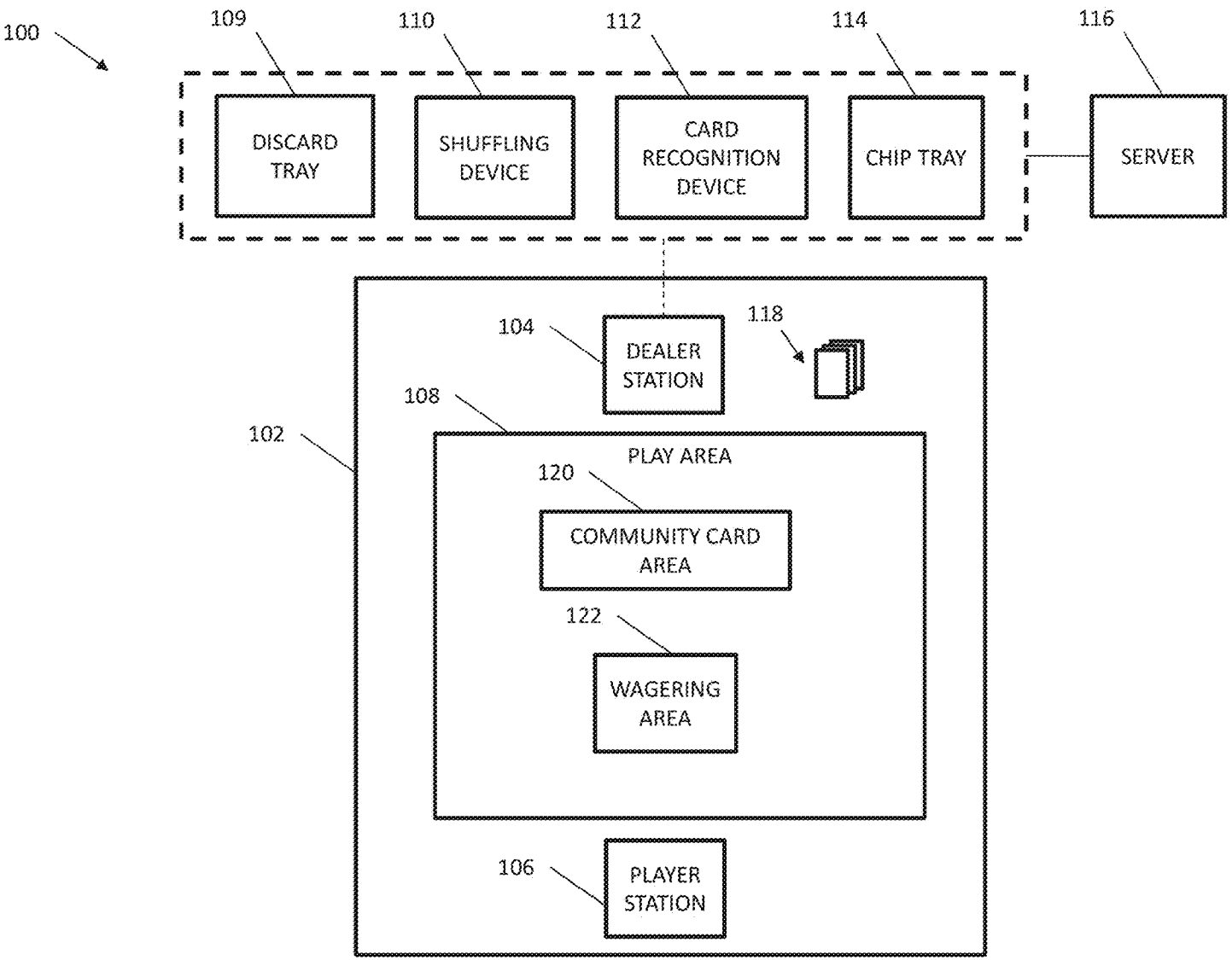
FIG. 1 is a block diagram of a system that may be used to provide a wagering game to one or more players.

The systems and methods described herein provide a wagering game to one or more players. The wagering game may be implemented on one or more electronic gaming machines that are coupled to a server by a network. Alternatively, the wagering game may be implemented as an online game that is presented to one or more players on one or more computing devices coupled to a server. Still alternatively, the wagering game may be implemented on a physical table using physical or virtual cards.

In one embodiment, the wagering game presented to the players is a unique Flip-It game. Alternatively, any suitable wagering game may be presented to the players. In one embodiment, the Flip-It game is a casino card game played with multiple decks of 52 standard poker cards with an adjustable number of forfeit cards included (e.g., jokers). The decks of cards are held within a "shoe" or another suitable device in preparation for dealing the cards. The game begins with the dealing and exposure of four cards. If a forfeit card appears in the initial four cards, it will be discarded into the discard rack until there are four cards exposed without a joker. The players place wagers regarding the fifth card being dealt or "flipped". The fifth card is sometimes referred to as the "Flip-It" card. The player may make one or more "inside wagers" on the Flip-It card as to whether it will be red or black, odd or even, and/or high or low. The player may also make one or more "call-it" wagers regarding the exact value of the Flip-It card. A bonus wager may also be available which is resolved according to the value of a five card poker hand formed by the five cards dealt. In one embodiment, the bonus wager may be won if the hand includes two pair up to a royal flush, including a pay-out for 5 of a kind. At the end of the hand, each card is shifted into new positions such that the Flip-It card will move into the fourth position and the first card in the sequence will then be placed into the discard rack awaiting the advent of the shuffle. If a forfeit card is dealt as the fifth card, all wagers from all players are automatically forfeited. At that point, the configuration of the four exposed cards will not change. In a subsequent round of gameplay, each player will make their wagers on the next card to flip based on those four cards.

The Flip-It game can be played with 1-6 players. Each player has their own wagering area on the table. In one embodiment, the Flip-It game may be played with an 8 deck shoe. The number of jokers included can include 16, 24, 32, or any suitable number. When the Flip-It game includes 16 jokers, the game becomes more liberal for the player such that the player enjoys a higher return-to-player (RTP) percentage. In contrast, when the Flip-It game includes 32 jokers, for example, the game provides a greater advantage to the house such that the house enjoys a higher house edge.

The inside wager is based on the characteristic of the flipped card. The characteristics can include the Flip-It card being even vs. odd, high vs. low, and having a suit that is colored red vs. black. The even wager numbers are 2, 4, 6, 8, 10, and Queen. The odd wager numbers are 3, 5, 7, 9, Jack, and King. The low numbers are 2-7. The high numbers are 8-King. In one embodiment, if an Ace is flipped, it can only be paid if the player has placed a wager on red or black (or in some cases if a bonus wager has been placed). Thus, an Ace is not considered to be odd or even and is not high or low. Therefore, if a player placed an inside wager on the Flip-It card being odd, even, high, or low, that inside wager would lose if an Ace is dealt as the Flip-It card.

The call-it wager is based on the face value or denomination of the Flip-It card. The call-it wager may be placed on any card value in the range from 2 through King and will win when the Flip-It card matches the exact value of the card value the player wagered on. The call-it wager does not include the Ace and would lose when an Ace is flipped.

The bonus wager is based on the five card configuration of the four cards exposed and the fifth card flipped to reveal a five card poker hand. The pay-outs for the bonus wager can vary based on the probability of each hand occurring within an 8 deck shoe, or based on any other suitable probability.

Accordingly, the above-described Flip-It game may provide increased excitement for players, while providing an easily understandable and engaging gameplay. Additional variations of the Flip-It game are described below.

Reference throughout this specification to "one embodiment", "an embodiment", "one example" or "an example" means that a particular feature, structure or characteristic described in connection with the embodiment of example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Embodiments in accordance with the present invention may be embodied as an apparatus, method, or computer program product. Accordingly, the present invention may take the form of an entirely hardware embodiment, an entirely software embodiment (including firmware, resident software, micro-code, etc.), or an embodiment combining software and hardware aspects that may all generally be referred to herein as a "module" or "system". Furthermore, the present invention may take the form of a computer program product embodied in any tangible media or expression having computer-usable program code embodied in the media.

Any combination of one or more computer-usable or computer-readable media (or medium) may be utilized. For example, a computer-readable media may include one or more of a portable computer diskette, a hard disk, a random access memory (RAM) device, a read-only memory (ROM) device, an erasable programmable read-only memory (EPROM or Flash memory) device, a portable compact disc read-only memory (CDROM), an optical storage device, and a magnetic storage device. Computer program code for carrying out operations of the present invention may be written in any combination of one or more programming languages.

Several (or different) elements discussed below, and/or claimed, are described as being "coupled", "in communication with" or "configured to be in communication with". This terminology is intended to be non-limiting, and where appropriate, be interpreted to include without limitation, wired and wireless communication using any one or a plurality of suitable protocols, as well as communication methods that are constantly maintained, are made on a periodic basis, and/or made or initiated on an as needed basis.

FIG. 1 is a block diagram of an exemplary system 100 that may be used to present a wagering game to one or more players. In the example illustrated in FIG. 1, the wagering game is presented as a table game played on a physical table 102. However, it should be recognized that the wagering game may be presented as a virtual or electronic game using one or more electronic gaming machines (EGMs), computing devices, servers, and/or other components of the systems described herein. In an embodiment, system 100 includes a table 102 that includes a dealer station 104, one or more player stations 106, and a play area 108.

In some embodiments, dealer station 104 includes a discard tray 109, an electronic or manual shuffling device 110, a card recognition device 112, and a chip tray 114. Alternatively, dealer station 104 may not include one or more of the above-identified devices or components. In one embodiment, one or more of the dealer station devices or components may be communicatively coupled to one or more servers 116.

Discard tray 109 is used to temporarily store cards that have been played in one or more previous rounds of gameplay. For example, after cards have been dealt during a round of gameplay, and each player's winnings have been determined, the cards may be placed into discard tray 109 until the cards are reshuffled and entered back into a later round of gameplay.

In one embodiment, shuffling device 110 is an electronic shuffling device configured to automatically shuffle a set 118 of physical cards, such as one or more decks of poker cards. A dealer may specify the number of decks to be shuffled, in some embodiments, or the electronic shuffling device may be configured to shuffle a predefined number of decks. The electronic shuffling device may automatically shuffle the set 118 of cards and provide the cards to the dealer to be dealt to play area 108. In one embodiment, electronic shuffling device 110 may communicate with server 116 to track a number of cards dealt or a number of decks shuffled, for example. Alternatively, shuffling device 110 may be a manual device (sometimes known as a "shoe") that may store the set 118 of cards (i.e., one or more shuffled decks of cards) or that may otherwise assist the dealer in shuffling and dealing the set 118 of cards. The shoe may include a customized and/or adjustable marker at which the dealer should insert newly shuffled cards and/or the cards from discard tray 109.

The set 118 of cards within shuffling device 110 may include any suitable number of decks of poker cards and any suitable number of "forfeit cards" that are described more fully herein. For example, the set 118 of cards may include a single fifty-two card deck with three forfeit cards, two fifty-two card decks with six forfeit cards, three fifty-two card decks with nine forfeit cards, eight fifty-two card decks with twenty-four forfeit cards, or any other suitable number of decks and forfeit cards. While the examples described herein include a ratio of three forfeit cards to one deck, it should be recognized that any suitable ratio of forfeit cards to decks may be used to provide a desired house edge and/or return to player percentage.

In one embodiment, card recognition device 112 includes an optical sensor for reading images of cards that pass over the optical sensor as the dealer deals the cards, for example. Alternatively, card recognition device 112 may include a wireless tag reader for reading electromagnetic tags embedded within the cards. The tag reader may be a radio frequency identification (RFID) reader that reads RFID tags embedded within the cards, a near-field communication (NFC) reader that reads NFC tags embedded within the cards, or any other suitable wireless tag reader. Card recognition device 112 may be a standalone device coupled to or integrated within table 102, or may be incorporated into electronic shuffling device 110 or another suitable device. Card recognition device 112 may communicate with server 116 to track each particular card that is dealt.

Chip tray 114 may be used for storing wagering chips that are used during the wagering game. In one embodiment, each wagering chip includes a wireless tag, such as an RFID or NFC tag, that identifies the denomination of the chip. Accordingly, chip tray 114 may include a wireless tag reader, such as an RFID or NFC tag reader, that automatically reads the tags of each chip stored within chip tray 114 and automatically identifies how many chips of each denomination is stored within chip tray 114. Chip tray 114 may transmit data representative of the identified chips and denominations to server 116 to enable server 116 to track the usage of the chips. Alternatively, chip tray 114 may not be used and wagering activity may occur instead using a touch screen device (not shown) integrated within, or positioned at each player station 106.

Player stations 106 are designated player positions around table 102 for each player playing the game. While only one player station 106 is illustrated in FIG. 1, it should be recognized that any suitable number of player stations 106 may be included at or around table 102.

Play area 108 is a portion of table 102 that is designated for displaying a plurality of community cards that are dealt during the game as well as for placing wagering chips associated with each player's wagers. Specifically, the dealer may deal the community cards into play area 108 so that each player may view the community cards and place one or more wagers based on the community cards.

In an embodiment that includes a server 116, server 116 may be coupled to one or more devices of dealer station 104, in one embodiment. Server 116 includes at least one processor (not shown) for controlling the operation of server 116 and for performing the functions of server 116 described herein. Server 116 may track the cards provided by electronic shuffling device 110 that are then dealt by the dealer, and may track the chips that are removed from chip tray 114 and that are then provided to each player. Accordingly, server 116 may audit the operation of the wagering game at table 102. Server 116 may also implement a player reward program, or may interface with a player reward server (not shown) that implements the program.

Play area 108 is adapted to enable one or more players to play a wagering game of "Flip-It" that is described more fully herein. Accordingly, unless otherwise specified, reference to "the wagering game" or "the game" refers to the Flip-It game. Play area 108 includes designated locations for receiving wagers from each of the players during the Flip-It game. For example, play area 108 includes a community card area 120 and a wagering area 122. Community card area 120 is shaped and sized to receive a plurality of community cards that are dealt by the dealer. In a specific embodiment, community card area 120 is shaped and sized to receive a total of five community cards during each round of the Flip-It game. Wagering area 122 is shaped and sized to receive one or more chips, tokens, or other physical objects associated with one or more wagers placed by a player. In one embodiment, a separate wagering area 122 is provided for each player playing the game at table 102. One example of play area 108 is illustrated in FIG. 2.

In an alternative embodiment, each wagering area 122 may be displayed within a touch screen device (not shown) that is integrated within, or coupled to, table 102 and/or to a respective player station 106. In such an embodiment, the players may use the touch screen devices to enter wagers instead of using physical chips. In addition, server 116 may communicate with the touch screen devices to establish a credit balance for each player, receive the wagering decisions and associated wager amounts from the players, maintain a credit balance associated with each player, decrease each player's credit balance based on each player's wagering activity, increase a player's credit balance according to an amount won by the player, and/or may automatically credit or transfer currency corresponding to the player's credit balance to an electronic account (such as a bank account) when a player leaves the table or initiates a cash out operation through the touch screen device.

Figure 2:
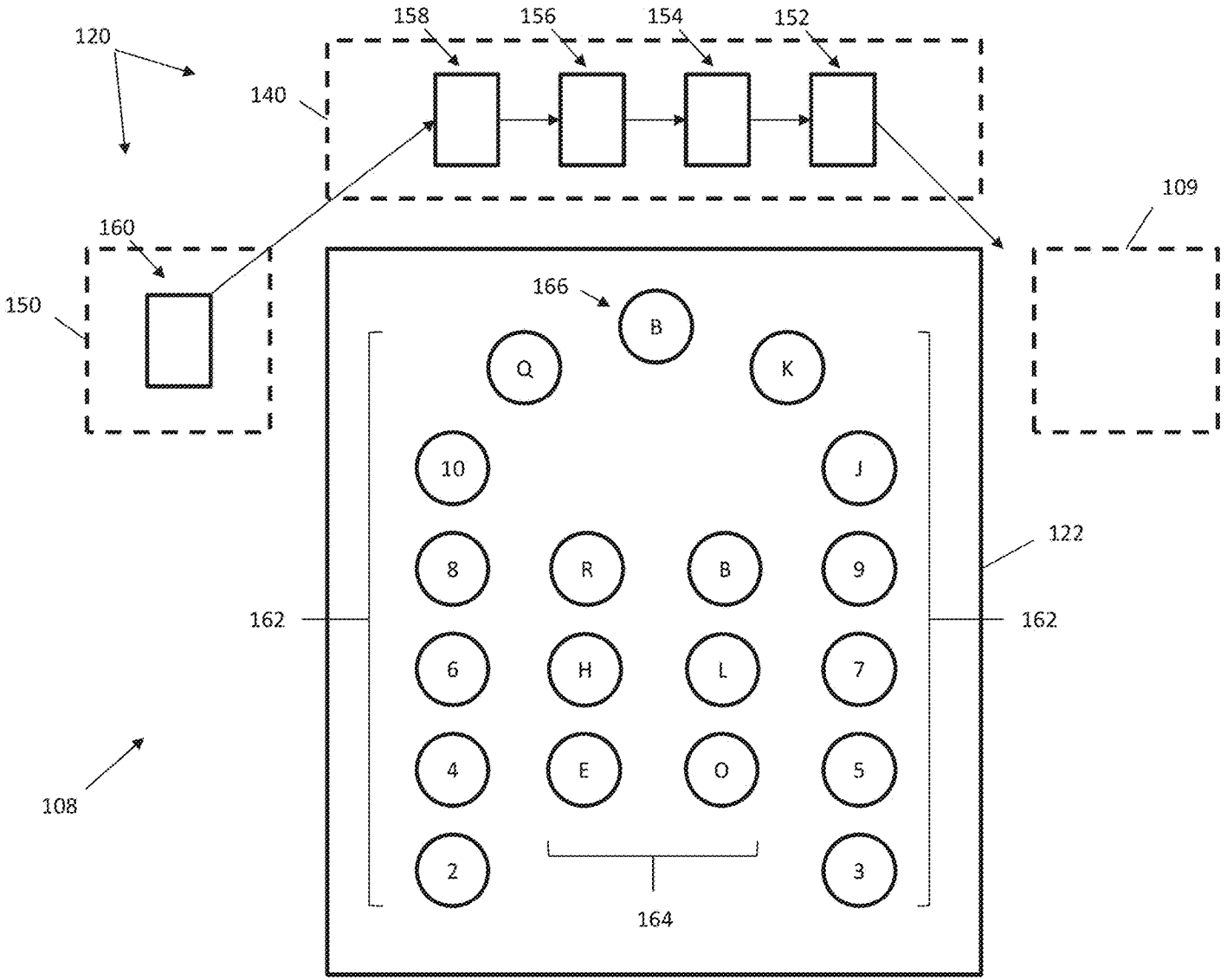
FIG. 2 is a block diagram of a play area that may be used with the system shown in FIG. 1.

FIG. 2 is a block diagram illustrating play area 108 of FIG. 1 according to one embodiment. In the embodiment illustrated in FIG. 2, play area 108 includes a first community card area 140 that includes positions for four community cards (i.e., a first position 152, a second position 154, a third position 156, and a fourth position 158) as well as a second community card area 150 that includes a fifth position 160 for a fifth community card (sometimes referred to herein as a "Flip-It card"). Alternatively, first and second community card areas 140 and 150 may be combined into a single community card area 120 that includes all five positions 152, 154, 156, 158, and 160. For the sake of clarity, the following embodiments will be described with reference to a single community card area 120 that includes all five positions 152, 154, 156, 158, and 160 with the understanding that any suitable arrangement and number of community card areas 120 may be included within play area 108.

In addition, in the embodiment illustrated in FIG. 2, play area 108 includes a discard area 109 and a wagering area 122 associated with a player. While a single wagering area 122 is illustrated in FIG. 2, it should be recognized that play area 108 may include a separate wagering area 122 for each player playing the game.

In one embodiment, discard area 109 includes a tray, receptacle, or other designated portion of table 102 that is shaped and sized to receive discarded community cards. For example, after a round of the Flip-It game has completed, the dealer will discard the community card in the first position 152 into discard area 109 as described more fully herein. In addition, the dealer may discard a "forfeit" card if the forfeit card is dealt into one of the first four positions 152, 154, 156, or 158. As discussed more fully herein, a forfeit card is a card that causes each player to forfeit their wagers in certain situations. In the embodiments described herein, the number of forfeit cards included in shuffling device 110 may be adjusted by the dealer or the house prior to gameplay to adjust the house edge of the Flip-It game.

Wagering area 122 includes a plurality of locations that are designated to receive one or more wagers from a player. The locations may include graphics or text imprinted on a surface of table 102, felt or other material coupled to the surface of table 102, and/or any other suitable designation that identifies the type and location of each wager that is able to be placed by the player. In one embodiment, the locations are arranged in categories including a plurality of call-it wager locations 162 for receiving one or more call-it wagers, a plurality of inside wager locations 164 for receiving one or more inside wagers, and a bonus wager location 166 for receiving a bonus wager. Thus, each location category (i.e., call-it wager locations, inside wager locations, and bonus wager location) corresponds to an associated wager category (i.e., call-it wagers, inside wagers, and bonus wager). It should be recognized that each player may place one or more wagers for one or more of the categories of locations. For example, a player may place two call-it wagers during the game, may place one call-it wager, a bonus wager, and two inside wagers, may place a single inside wager, or may place any other number of wagers on any number of the wager categories.

In one embodiment, call-it wagers are wagers that a player may place in an attempt to guess the actual card value of the Flip-It community card (discussed below). For example, if the player places a first call-it wager on the card value 2 and a second call-it wager on the card value Queen (designated as "Q" in FIG. 2), the player will win the first call-it wager if a 2 of any suit is dealt as the Flip-It card. Likewise, the player will win the second call-it wager if a Queen of any suit is dealt as the Flip-It card. The player may place a call-it wager on any number of card values within play area 108, or may choose to forego the placing of a call-it wager.

In an embodiment, inside wagers are wagers that a player may place in an attempt to guess a characteristic of the Flip-It card which will be dealt during the game. The characteristics of the Flip-It card that may be the subject of the inside wager include a suit color of the card (designated as "R" for red or "B" for black in FIG. 2), whether the card is a high card or a low card (designated as "H" and "L", respectively, in FIG. 2), or whether the card is even or odd (designated as "E" and "O", respectively, in FIG. 2). The high cards include card values of 8, 9, Jack (J), Queen (Q), or King (K) while low cards include card values of 2, 3, 4, 5, 6, or 7. The even cards include card values of 2, 4, 6, 8, 10, Q while odd cards include card values of 3, 5, 7, 9, J, or K. In one embodiment, an Ace is only able to be paid out on a winning inside wager of the suit color, so the only way that a player may win a wager in which the Flip-It card is an Ace is by winning the inside wager regarding the suit (e.g., red or black) or by winning a bonus wager. Thus, the Ace is not considered to be either even or odd, or high or low in some embodiments.

A bonus wager is a wager that a player may place in the hope that the Flip-It card will form one of a plurality of winning hands in combination with the other four community cards dealt. In one embodiment, the bonus wager is initially disabled or unavailable such that the players are unable to place a bonus wager. Once a predetermined condition is met, however, the bonus wager is enabled or made available by the dealer so that the players may place a bonus wager. In one embodiment, the predetermined condition is met when the hand formed by the five community cards in a most-recently played round was a winning poker hand having a rank of a pair or higher. In a further embodiment, the winning poker hand does not include a straight, flush, or straight flush such that the hand formed by the five community cards will not enable a player to win the bonus wager if the hand only includes a straight, a flush, or straight flush, unless an Ace has been dealt as the Flip-It card. Alternatively, the predetermined condition may include the formation of any other suitable hand in a prior round, or any other suitable condition. A player may win the bonus wager if the hand formed by the five community cards in the present round of gameplay is a winning poker hand having a rank of two pairs or higher. Alternatively, the player may win the bonus wager if the hand formed by the five community cards is any other suitable winning hand. In one embodiment, the bonus wager is only won if the Flip-It card creates the winning poker hand (i.e., not if the winning poker hand was formed by the first four community cards).

Operation of the Flip-It Game

During operation, the Flip-It game is played by each player at table 102. Before any wagers are placed by the players, the dealer deals the first four community cards from the set 118 of cards into community card area 120 and exposes the cards to the players. The cards are sequentially placed into the positions identified in FIG. 2 in the order they were dealt. Thus, the first community card is placed in first position 152, the second community card is placed in second position 154, the third community card is placed in third position 156, and the fourth community card is placed in fourth position 158. If a forfeit card is dealt as one of the first four community cards, the forfeit card is immediately discarded into discard area 109 and a new card is dealt to replace the forfeit card.

After the first four community cards are dealt, each player places at least one wager in one or more of the wager categories described above. More specifically, the player may place one or more inside wagers, one or more call-it wagers, and/or a bonus wager (assuming that the bonus wager is made available as described above). Each player may place the one or more wagers by placing one or more wagering chips or other tokens on a location within wagering area 122 associated with that particular wager. For example, if the player wants to place an inside wager on red (i.e., on the expectation that the Flip-It card will be dealt having a red-colored suit), the player may place one or more chips on the "R" location illustrated in FIG. 2.

After each player has placed their wagers, the dealer deals the fifth community card (the Flip-It card) from the set 118 of cards into community card area 120 and exposes the card to the players. More specifically, the dealer places the Flip-It card into fifth position 160. The dealer then evaluates each player's wagers to determine which wagers were won by each player and any resulting payout. For example, if the player placed an inside wager on red and the Flip-It card was dealt having a red-colored suit, the player would win that particular inside wager and would receive a payout associated with that wager. However, if a forfeit card is dealt as the Flip-It card, all players automatically forfeit their wagers and the current round of gameplay ends.

The payouts associated with winning each type of wager may be set and adjusted by the house according to a desired house edge or return to player (RTP) value. In one embodiment, each wager category will have its own separate pay table. The casino or other gaming establishment that operates the Flip-It game may decide if they want a more liberal game (i.e., higher RTP) by placing more or less forfeit cards in their 8 deck shoe. In addition, the casino may choose what the pay-outs are for all of the wagers available. For example, the call-it wagers may be payed 10 to 1 with a rounded maximum pay out of 12 to 1. The bonus wagers may be paid 1 to 1 for a pair with a rounded maximum pay out of 2 to 1. The casino may also decide at what shoe-depth-penetration they want to deliver as a way to facilitate auditing and ease of card counting, to facilitate delivering a desired number of hands per hour, and to specify at what point to shuffle the cards in the discard tray back into the shuffling device. The creator of this game suggests a beneficial ratio for casino and player will be with 24 jokers at 25% penetration.

After any payouts have been completed, the current round of gameplay is finished and a new round may begin. In preparation for the new round of gameplay, a determination is made regarding whether the bonus wager will be enabled in the new round. This determination is made based on a hand formed by all five community cards dealt in the most-recently completed round of gameplay. In one embodiment, if the hand matches one of a plurality of winning poker hands, the bonus wager will be enabled or made available in the upcoming round of gameplay. For example, if the hand includes a pair of cards or is ranked higher than a pair, the bonus wager may be made available in the upcoming round of gameplay. In one embodiment, the bonus wager will not be enabled if the poker hand only includes a flush, straight, or straight flush.

After the determination is made regarding whether the bonus wager is available, each community card within community card area 120 is shifted in position, with the community card in first position 152 being discarded into discard area 109. As a result, the community card in second position 154 is moved into first position 152, the community card in third position 156 is moved to second position 154, the community card in fourth position 158 is moved into third position 156, and the community card in fifth position 160 (i.e., the Flip-It card from the most-recently completed round of gameplay) is moved into fourth position 158. Thus, in the new round of gameplay, the first four community cards are already provided such that the dealer only needs to deal a new Flip-It card to be placed in fifth position 160. In other respects, the new round of gameplay proceeds in a similar manner as described above.

Variations of the Flip-It Game

Variations of the Flip-It game may also be used with the system 100 shown in FIG. 1 as well as the other systems and embodiments described herein. In a first variation, a separate wager (referred to herein as a "forfeit wager") may be placed on the chance that a forfeit card may be dealt as the Flip-It card. In such an embodiment, the dealing of the forfeit card as the Flip-It card would cause all other wagers to be forfeited except for the forfeit wager. The player that placed the forfeit wager would then be awarded a payout associated with the forfeit wager.

In a second variation, one or more bonus cards may be included within the set 118 of cards used by shuffling device 110. The bonus card, when dealt, would cause a bonus to be applied to the wagers placed and won by the players. In one embodiment, the bonus card may be a golden ticket or may be any other suitable bonus identifier.

In a third variation, a "deuces wild" version may be provided in which any card having a card value of 2 (i.e., a "deuce") will be wild. As a result, in one embodiment, each deuce may therefore be considered to have any card value that would enable a player to win a call-it wager, an inside wager, or a bonus wager.

In a fourth variation, an additional (sixth) card may be dealt and may be considered when forming a poker hand for resolving the bonus wager. In one embodiment, the sixth card may only be dealt when the bonus wager is available to be placed. Alternatively, the sixth card may be dealt in any round of gameplay regardless of whether the bonus wager is available to be placed. A separate pay table may be provided for the formation of a six card poker hand relating to the bonus wager.

In a fifth variation, a progressive bonus prize may be provided. A portion of each wager (or a portion of each bonus wager) may be apportioned to the progressive prize, and the progressive prize may be awarded when a predetermined poker hand is formed as a result of the bonus wager being available and one or more players placing a bonus wager.

In a sixth variation, the dealer may initially deal and display the Flip-It card, and the players may successively place wagers on the formation of a poker hand (similar to the bonus wager) as the dealer sequentially deals and displays each of the community cards in the first, second, third, and fourth positions 152, 154, 156, 158. If the resulting five card poker hand matches one or more predetermined winning hands, the players may win a resulting pay-out.

In a seventh variation, the dealer may initially deal or display the Flip-It card, and the players may successively place wagers on the formation of a poker hand (similar to the bonus wager) as the dealer sequentially deals and displays each of the community cards in the first, second, third, and fourth positions 152, 154, 156, and 158. However, in contrast to the sixth variation described above, the players may take back their wagers in sequence after each community card is revealed. If the resulting five card poker hand matches one or more predetermined winning hands, the players may win a resulting pay-out.

In an eighth variation, a separate bonus payout may be provided when one or more predetermined hands are formed by the five community cards dealt. The predetermined hands may include a straight, a flush, a straight flush, and/or any other suitable hand.

It should be recognized that the above-described variations and embodiments are meant to be examples only, and are not intended to be limiting.

Figure 3:
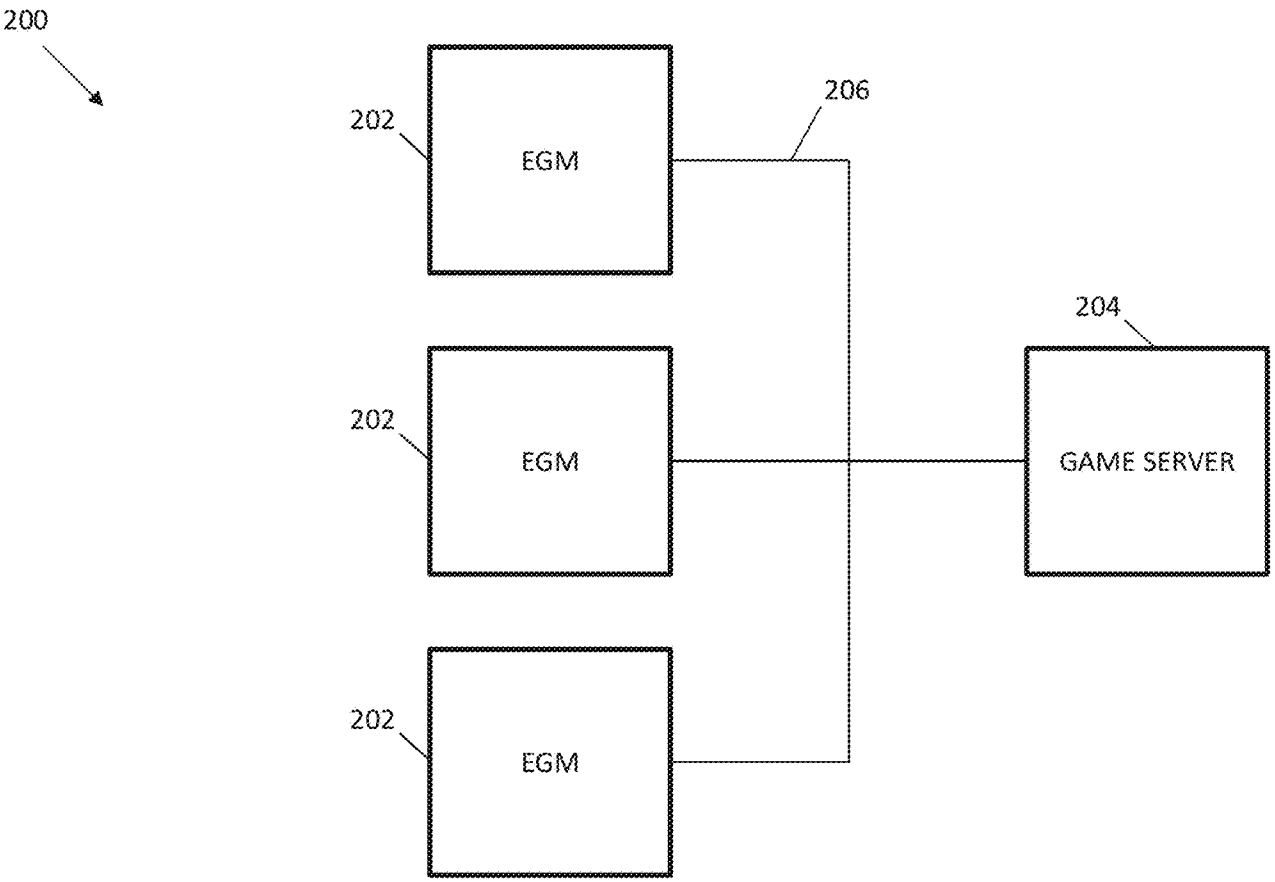
FIG. 3 is a block diagram of a system that may be used to provide a wagering game to one or more players using one or more electronic gaming machines.

FIG. 3 is a block diagram of a system 200 that may be used to provide a wagering game to a plurality of players. In the example illustrated in FIG. 3, system 200 includes a plurality of electronic gaming machines (EGMs) 202 that are coupled to at least one server, such as a game server 204, via a network 206. Each EGM 202 may include a plurality of EGM components 300 that are illustrated and described with reference to FIG. 4. Game server 204 may include at least one processor (not shown) for controlling the operation of game server 204 and for performing the functions of game server 204 described herein.

Referring to FIG. 3, each EGM 202 may be operated by a respective player to play a wagering game, such as an electronic version of the Flip-It game described above with reference to FIG. 1. In one embodiment, the game is implemented on each EGM 202 and each EGM operates separately and independently from each other EGM 202. In another embodiment, the game is implemented on each EGM 202 while the gameplay of each EGM 202 is coordinated by game server 204 (i.e., by a processor of game server 204). Accordingly, each player may play the game on a respective EGM 202 in a networked manner with each other player playing on respective EGMs 202. Alternatively, the game may be implemented on game server 204 and may be communicated to each EGM 202 such that each EGM 202 may display game screens and may receive player inputs, wager inputs, and wagering decisions associated with the game. In both embodiments, each EGM 202 may transmit the player inputs, wager inputs, and wagering decisions to game server 204. The following embodiments are described in which the game is implemented on each EGM 202 with the understanding that the descriptions may also apply to the embodiment in which the game is implemented on game server 204 with appropriate modifications.

In one embodiment, each EGM 202 may be coupled to game server 204 to enable each player to play against each other using a respective EGM 202. Accordingly, each player may participate in a joint wagering game by entering inputs representative of wagers, wagering decisions, and gameplay decisions using interfaces of each EGM 202. The inputs of each player are transmitted to game server 204 as discussed in more detail herein. It should be recognized that the game may alternatively be played by a single player operating a single EGM 202 in communication with game server 204 to enable the player to play against the house as opposed to playing with other players.

Figure 4:
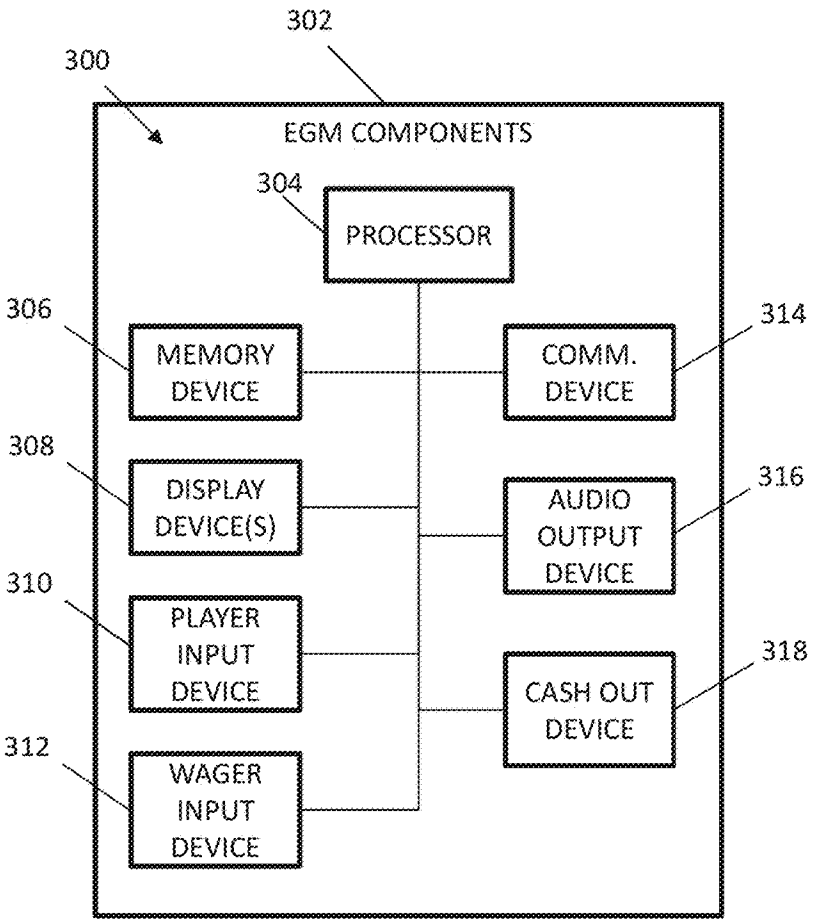
FIG. 4 is a block diagram of electronic gaming machine components that may be used with the electronic gaming machines shown in FIG. 3.

Referring to FIG. 4, each EGM 202 may include a plurality of EGM components 300 positioned within a housing or cabinet 302, including a processor 304, a memory device 306, a display device 308, a player input device 310, a wager input device 312, a communication device 314, an audio output device 316, and a cash out device 318. Alternatively, one or more of the EGM components 300 may be combined together in some embodiments.

Processor 304 is used to control an operation of EGM 202. Processor 304 may include, for example, a microprocessor, a microcontroller-based platform, a suitable integrated circuit or one or more application-specific integrated circuits (ASIC's). Processor 304 may be a single core processor or a multi-core processor and may be capable of processing multiple threads simultaneously.

Memory device 306 includes one or more computer-readable media that may store computer-executable instructions that are executable by processor 304, for example, to perform the functions of EGM 202. Memory device 306 may also store data usable by processor 304 to implement the game described herein and/or to implement any of the other functions described herein. Memory device 306 may include random access memory (RAM), flash memory, one or more hard disks, and/or other forms of memory including electrically erasable programmable read only memory (EEPROM) or the like. The RAM memory may include non-volatile RAM (NVRAM), magnetic RAM (MRAM), or ferroelectric RAM (FeRAM), and/or any other suitable form of RAM.

Display device 308 may be secured to housing 202 to enable a player to view game content such as a virtual table of the wagering game as well as the cards and/or representations of the players playing the game. The virtual table corresponds to table 102 and includes the same layout and features in some embodiments. Display device 308 may include one or more monitors, televisions, projectors, plasma displays, liquid crystal displays (LCD), displays based on light emitting diodes (LEDs), displays based on a plurality of organic light-emitting diodes (OLEDs), or any other suitable electronic device or display mechanism. In one embodiment, display device 308 includes a touch-screen with an associated touch-screen controller. In a specific embodiment, display device 308 may include a first display coupled to a top portion of housing 202 and a second display positioned below the first display. The first display may display the gameplay of the wagering game and the second display may display other information related to the game or EGM 202, such as wager amounts, an amount of credits available to be used in the game, player reward status, and the like. Alternatively, the position or location of the content displayed on the first and second displays may be switched.

Player input device 310 may include one or more buttons, a keyboard, a mouse, a trackball, a joystick, a touch-screen, a microphone cooperating with a speech recognition module, an optical sensor cooperating with a gesture control device, and/or any other suitable device that enables a player to input data or commands into EGM 202. The player may use player input device 310 to input game play commands and to input wagers during the game, for example.

Wager input device 312 may include an acceptor configured to receive a physical item associated with a monetary value. For example, wager input device 312 may include a bill acceptor configured to receive and identify paper currency input into EGM 202, a scanner configured to identify and read tickets or vouchers having an amount of currency or credits identified therein, an NFC reader configured to receive data representative of an amount of currency or credits to be input into EGM 202 from a mobile phone or other device, and/or any other suitable device that enables EGM 202 to receive an amount of currency or credits to be used during the game. Wager input device 312 may receive the physical item associated with a monetary value, may extract or identify the monetary value associated therewith, and may transmit data to processor 304 indicating the monetary value. In response, processor 304 may add the monetary value to a credit balance stored within EGM 202 for use in the game.

Communication device 314 enables EGM 202 to communicate with other EGMs 202 and/or with game server 204. Communication device 314 may include, for example, a wired Ethernet interface (e.g., using IEEE 802.3), a wireless Ethernet interface (e.g., using IEEE 802.11), a mesh network interface, a Bluetooth interface, a cellular or telephone modem, and/or any other suitable device that enables EGM 202 to communicate with game server 204 and/or other EGMs 202. In one embodiment, communication device 314 transmits data to, and receives data from, game server 204 via a local area network (LAN), a wide area network (WAN), a casino area network (CAN), the Internet, the public switched telephone network (PSTN), and/or any other suitable network.

Audio output device 316 includes one or more speakers or other devices that enables EGM 202 to output audible and/or inaudible sounds to the player or to another suitable recipient. For example, EGM 202 may control audio output device 316 to generate audible game play sounds related to the game and/or to notify casino personnel about the status of EGM 202.

Cash out device 318 may include a bill dispenser, a coin dispenser, or a printer that prints vouchers or tickets having computer-readable indicia representing an amount of credits or currency dispensed to the player. In one embodiment, when a player operates player input device 310 to initiate a cash out operation on EGM 202, processor 304 transmits data to cash out device 318 to cause cash out device 318 to dispense one or more physical items representing the credit balance of the player on EGM 202. For example, processor 304 may transmit data to cash out device 318 indicating an amount of currency to dispense (i.e., corresponding to all or a selected portion of the player's credit balance), or may transmit data to cash out device 318 indicating an amount of currency or credits to print on a voucher that is presented to the player. Processor 304 decreases the credit balance of EGM 202 by the amount of currency or credits dispensed during the cash out operation.

The electronic version of the Flip-It game may be implemented as a single player wagering or video game played on a single EGM 202. Alternatively, the game may be played by a plurality of players playing on respective EGMs 202 and may be centrally administered or coordinated by game server 204. In embodiments in which game server 204 administers or coordinates the gameplay of the Flip-It game, each player inputs game play commands and wagering decisions using a respective player input device 310, and data representative of the player inputs are transmitted to game server 204. Game server 204, in turn, transmits data representative of each player's inputs and decisions to EGMs 202 associated with each other player to cause the respective EGM 202 to display the results of the inputs.

The game may include a modified single deck of fifty-two standard poker cards with a predetermined number of forfeit cards as described above. The EGM 202 or server 204 may continuously shuffle the cards until the player starts the game. When the player pushes a deal button (not shown) or otherwise operates a player input device 310 of EGM 202 to initiate the gameplay, the shuffling of the deck will stop and the screen will display the next four cards from the deck in sequence. The deck will then begin to continuously shuffle again. The player will then make their inside, call-it, and/or bonus wagers as described above. The player will then push a Flip-It button (not shown) or otherwise operate the player input device 310 of EGM 202 to cause the EGM 202 to stop shuffling the deck. The EGM 202 will display the next card in sequence as the Flip-It card. The player will win or lose based on the value of the card displayed as the card is resolved (in combination with the other community cards) against the player's chosen wagers. In other respects, the electronic implementation of the Flip-It game is similar to the implementation described above with reference to FIGS. 1 and 2 with the various aspects of the game being displayed on display device 308 of EGM 202. After the wagers have been placed and the cards have been dealt, EGM 202 or game server 204 may determine an award or prize to be provided to each player in a similar manner as described above with reference to FIGS. 1 and 2. While the continuous shuffling method has been described herein with reference to the EGM implementation, it should be recognized that a dealer may employ a similar continuous shuffling method using shuffling device 110, or the computing devices described herein may employ a similar shuffling method.

Each time a player enters a wager through player input device 310, processor 304 reduces the player's available credit balance by the wagered amount. Conversely, if the player wins an award, processor 304 increases the player's credit balance by the amount awarded by game server 204 or EGM 202. When the player has finished a play session on EGM 202, the player may cash out the remaining credit balance by initiating a cash out operation through player input device 310 (e.g., by pressing a cash out button or the like). In response, processor 304 causes cash out device 318 to dispense all or a selected portion of the credit balance to the player in the form of physical currency, a voucher or ticket identifying the credit balance, or another suitable representation of the credit balance. Processor 304 deducts the cashed out amount from the credit balance.

Figure 5:
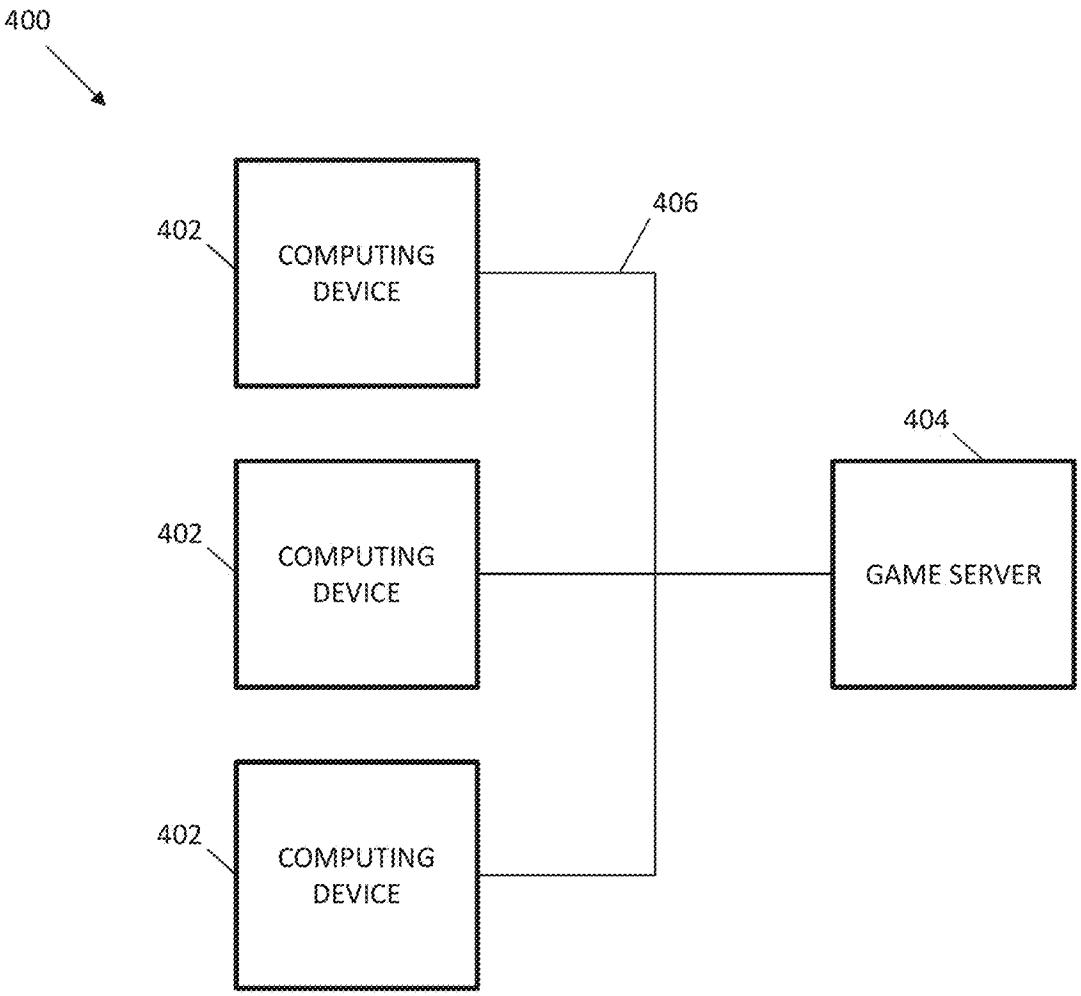
FIG. 5 is a block diagram of another system that may be used to provide a wagering game to one or more players using one or more computing devices.

FIG. 5 is a block diagram of another system 400 that may be used to provide a wagering game to a plurality of players. In the example illustrated in FIG. 5, system 400 includes a plurality of computing devices 402 that are coupled to at least one server, such as a game server 404, via a network 406. In the embodiments described herein, computing devices 402 may interact with game server 404 to provide an online Flip-It wagering game to the player of each computing device 402. Each computing device 402 may include a plurality of computing device components 500 that are illustrated and described with reference to FIG. 6. Game server 404 may include at least one processor (not shown) for controlling the operation of game server 404 and for performing the functions of game server 404 described herein.

Referring to FIG. 5, each computing device 402 may be operated by a respective player to play an online Flip-It game as described above with reference to FIG. 1. In one embodiment, the game is implemented on each computing device 402 while the gameplay of each computing device 402 is coordinated by game server 404. Accordingly, each player may play the game on a respective computing device 402 in a networked manner with each other player playing on respective computing devices 402. Alternatively, the game may be implemented on game server 404 and may be communicated to each computing device 402 such that each computing device 402 may display game screens and may receive player inputs and wager inputs associated with the game. In both embodiments, each computing device 402 may transmit the player inputs and wager inputs to game server 404. The following embodiments are described in which the game is implemented on each computing device 402 with the understanding that the descriptions may also apply to the embodiment in which the game is implemented on game server 404 with appropriate modifications. It should be recognized that the game may alternatively be played by a single player operating a single computing device 402 in communication with game server 404 to enable the player to play against the house as opposed to playing with other players.

Each computing device 402 may be coupled to game server 404 to enable each player to play against each other using a respective computing device 402. Accordingly, each player may participate in a joint Flip-It game by entering inputs representative of wagers and gameplay decisions using player input devices of each computing device 402. The inputs of each player are transmitted to game server 404 as discussed in more detail herein.

Computing devices 402 may include, for example, one or more laptop computers, desktop computers, tablet computing devices, smart phones, wearable computing devices (e.g., smart watches or the like), or any other suitable computing device.

Figure 6:
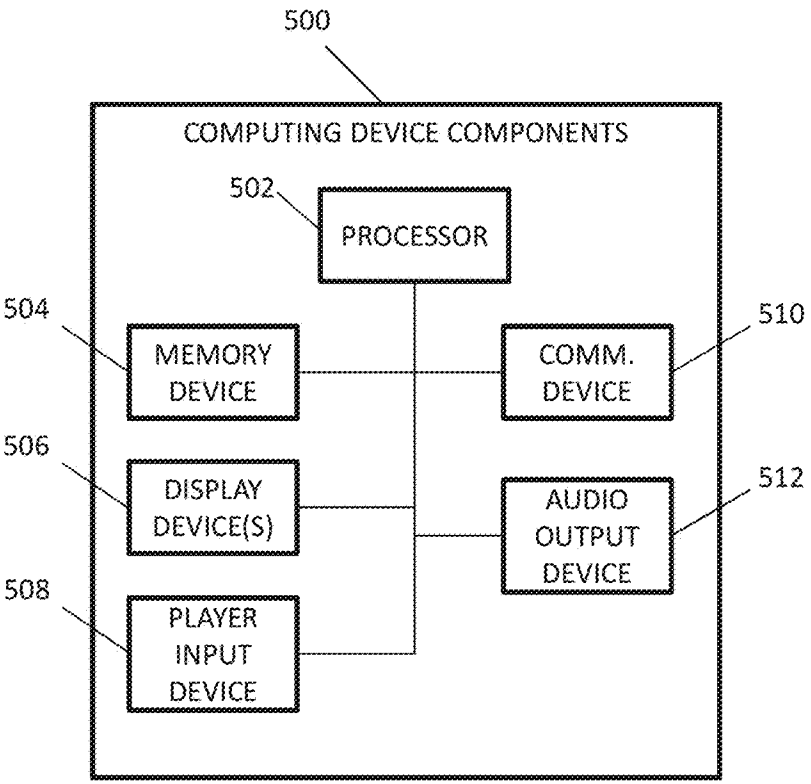
FIG. 6 is a block diagram of computing device components that may be used with the computing devices shown in FIG. 5.

Referring to FIG. 6, each computing device 402 may include a plurality of computing device components 500, including a processor 502, a memory device 504, a display device 506, a player input device 508, a communication device 510, and an audio output device 512. Alternatively, one or more of the computing device components 500 may be combined together in some embodiments.

Processor 502 is used to control an operation of computing device 402. Processor 502 may include, for example, a microprocessor, a microcontroller-based platform, a suitable integrated circuit or one or more application-specific integrated circuits (ASIC's). Processor 502 may be a single core processor or a multi-core processor and may be capable of processing multiple threads simultaneously.

Memory device 504 includes one or more computer-readable media that may store computer-executable instructions that are executable by processor 502, for example, to perform the functions of computing device 402. Memory device 504 may also store data usable by processor 502 to implement the game described herein and/or to implement any of the other functions described herein. Memory device 504 may include random access memory (RAM), flash memory, one or more hard disks, and/or other forms of memory including electrically erasable programmable read only memory (EEPROM) or the like. The RAM memory may include non-volatile RAM (NVRAM), magnetic RAM (MRAM), or ferroelectric RAM (FeRAM), and/or any other suitable form of RAM.

Display device 506 may enable a player to view game content such as a virtual table of the wagering game as well as the cards and representations of the players playing the game. The virtual table corresponds to table 102 and includes the same layout and features in some embodiments. Display device 506 may include one or more monitors, televisions, projectors, plasma displays, liquid crystal displays (LCD), displays based on light emitting diodes (LEDs), displays based on a plurality of organic light-emitting diodes (OLEDs), or any other suitable electronic device or display mechanism. In one embodiment, as described in more detail below, display device 506 includes a touch-screen with an associated touch-screen controller. In a specific embodiment, display device 506 may display the gameplay of the wagering game and other information related to the wagering game, such as wager amounts, an amount of credits available to be used in the game, player reward status, and the like.

Player input device 508 may include one or more buttons, a keyboard, a mouse, a trackball, a joystick, a touch-screen, a microphone cooperating with a speech recognition module, an optical sensor cooperating with a gesture control device, and/or any other suitable device that enables a player to input data or commands into computing device 402. The player may use player input device 508 to input game play commands and to input wagers during the game, for example.

Communication device 510 enables computing device 402 to communicate with other computing devices 402 and/or with game server 404 using one or more networks 406. Communication device 510 may include, for example, a wired Ethernet interface (e.g., using IEEE 802.3), a wireless Ethernet interface (e.g., using IEEE 802.11), a mesh network interface, a Bluetooth interface, a cellular or telephone modem, and/or any other suitable device that enables computing device 402 to communicate with game server 404. In one embodiment, communication device 510 transmits data to, and receives data from, game server 404 via a local area network (LAN), a wide area network (WAN), a casino area network (CAN), the Internet, the public switched telephone network (PSTN), and/or any other suitable network.

Audio output device 512 includes one or more speakers or other devices that enables computing device 402 to output audible and/or inaudible sounds to the player or to another suitable recipient. For example, computing device 402 may control audio output device 512 to generate audible game play sounds related to the game.

During operation, a player may operate computing device 402 to play a wagering game, such as the Flip-It game, according to the embodiments described herein. In one embodiment, the game is played by a plurality of players playing on respective computing devices 402 and is centrally administered or coordinated by game server 404. Accordingly, the players may play against each other or against the house in an online wagering game using their respective computing device 402. Alternatively, a player may operate computing device 402 to play a standalone Flip-It game. In such an embodiment, game server 404 may administer or coordinate the gameplay on computing device 402, or computing device 402 may independently provide and operate the game.

The player may join the game by operating a button or other portion of player input device 508. In response, processor 502 transmits a signal to game server 404 and game server 404 causes the player to join the game along with (optionally) one or more other players. The player may initially establish a credit balance for use in the game by operating computing device 402 to transfer money or credits from a debit or credit account, for example, to an account associated with the game. As the game play progresses, each player inputs game play commands and wagers using a respective player input device 508, and data representative of the player inputs are transmitted to game server 404. Game server 404, in turn, transmits data representative of each player's inputs and decisions to computing devices 402 associated with each other player to cause the respective computing device 402 to display the results of the inputs.

In one embodiment, the specific game play of the Flip-It game is substantially similar to the game play of the game described above with respect to FIG. 1. After the wagering decisions have completed and the community cards have been dealt, game server 404 or computing device 402 may determine an award or prize to be provided to each player based on the wagers won by each player.

Each time a player enters a wager through player input device 508, processor 502 reduces the player's available credit balance by the wagered amount. Conversely, if the player wins an award, processor 502 increases the player's credit balance by the amount awarded by game server 404. When the player has finished a play session on computing device 402, the player may cash out the remaining credit balance by initiating a cash out operation through player input device 508 (e.g., by selecting a cash out icon, or the like). In response, processor 502 may cause all or a selected portion of the credit balance to be electronically transferred to an account of the player, such as a bank account. Processor 502 may then deduct the cashed out amount from the credit balance.

Although specific features of various embodiments of the disclosure may be shown in some drawings and not in others, this is for convenience only. In accordance with the principles of the disclosure, any feature of a drawing or other embodiment may be referenced and/or claimed in combination with any feature of any other drawing or embodiment.

This written description uses examples to describe embodiments of the disclosure and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A system to provide an on-line game to one or more players comprising:

at least one server;

at least one user computing device to communicate with the at least one server via a network;

the at least one user computing device comprising:

a processor to control operation of the at least one user computing device;

a player input device configured to receive an input representative of a wager amount from a player operating the at least one user computing device, wherein the monetary value is added to a credit balance associated with the player and a wager amount is deducted from the credit balance;

a communication device to enable the at least one user computing device to communicate with the at least one server; and a display device to enable a player to view game content of the on-line game; and the at least one server including a processor configured to:

provide an on-line game to the at least one user computing device, wherein the on-line game includes a virtual table displayed on the display device;

deal four community cards to a community area of the virtual table;

receive an input associated with a wager entered by the player input device, the wager being associated with an expected characteristic of a fifth community card to be dealt during the on-line game;

deal the fifth community card;

determine whether the at least one user computing device wins the wager based on the actual characteristic of the fifth community card matching the expected characteristic associated with the player's wager;

determine an award to be received by the at least one user computing device based on winning the wager;

add the award to the credit balance of the at least one user computing device;

receive an input from the at least one user computing device to initiate a cash out operation; and cause a transfer of currency corresponding to the credit balance to an electronic account when the cash out operation is initiated.

2. The system in accordance with claim 1, wherein the processor of the server is configured to deal the community cards from a set of cards, and wherein the processor of the server is configured to adjust the size of the set of cards to adjust a house edge of the on-line game.

3. The system in accordance with claim 2, wherein the processor of the server is configured to adjust the size of the set of cards by adjusting a number of forfeit cards included within the set of cards.

4. The system in accordance with claim 1, wherein the processor of the server is configured to automatically cause the player to lose the wager when a forfeit card is dealt as the fifth community card.

5. The system in accordance with claim 1, wherein the processor of the server is configured to replace the forfeit card instead of causing the player to lose the wager when the forfeit card is dealt as one of the four community cards.

6. The system in accordance with claim 1 wherein the at least one user computing device comprises a plurality of user computing devices coupled to the at least one server via the network.

7. The system in accordance with claim 6 wherein the on-line game is implemented on the at least one server and each of the user computing devices operates separately and independently from each other.

8. The system in accordance with claim 6 wherein the on-line game is implemented on the at least one server and each of the user computing devices plays against each other.

9. The system in accordance with claim 6 wherein the on-line game is implemented on each of the user computing devices while the gameplay of each of the user computing devices is coordinated by the at least one server.

10. The system in accordance with claim 6 wherein the on-line game is implemented on each of the user computing devices and each of the user computing devices operates separately and independently from each other.

11. A method of providing a game to a player on an on-line gaming system, the method comprising:

accepting a wager associated with a monetary value from a player via a player input device of the at least one user computing device, wherein the monetary value is added to a credit balance associated with the player and a wager amount is deducted from the credit balance;

dealing four community cards to a community area of a virtual table displayed on a display device of the at least one user computing device;

receiving the wager via the player input device an input representative of the wager amount from the player operating the at least one user computing device, the wager being associated with an expected characteristic of a fifth community card to be dealt during the game;

dealing the fifth community card;

determining whether the player wins the wager based on the actual characteristic of the fifth community card matching the expected characteristic associated with the player's wager;

determining an award to be received by the player based on the player winning the wager;

adding the award to the credit balance of the player;

receiving an input from the player to initiate a cash out operation; and causing a transfer of currency corresponding to the credit balance to an electronic account when the cash out operation is initiated.

12. The method in accordance with claim 11, wherein the community cards are dealt from a set of cards, and wherein the size of the set of cards is adjustable to adjust a house edge of the wagering game.

13. The method in accordance with claim 12, further comprising adjusting the size of the set of cards by adjusting a number of forfeit cards included within the set of cards.

14. The method in accordance with claim 13, wherein the forfeit cards are jokers.

15. The method in accordance with claim 13, further comprising causing the player to lose the wager when a forfeit card is dealt as the fifth community card.

16. The method in accordance with claim 15, further comprising replacing the forfeit card instead of causing the player to lose the wager when the forfeit card is dealt as one of the four community cards.

17. The method in accordance with claim 11, further comprising dealing the five community cards in a first round in which each community card is arranged in a first, second, third, fourth, and fifth position according to the order the community card was dealt, and wherein a second round is initiated in which the community card in the first position is discarded, the community cards in the second, third, and fourth positions are each shifted one position, and the fifth community card is moved into the fourth position.

18. The method in accordance with claim 17, further comprising dealing a new community card to be placed in the fifth position during the second round.

19. The method in accordance with claim 11, wherein the wager is placed on at least one of three categories of wagers: an inside wager associated with the expected characteristic of the fifth community card; a call-it wager associated with an expected card value of the fifth community card; and a bonus wager associated with an expected winning hand to be formed by the combination of the five community cards.

20. The method in accordance with claim 19, wherein the bonus wager is initially deactivated such that the player may not place the bonus wager in a current round unless the combination of the five community cards in a most-recently played round matches one of a plurality of predetermined hands.

* * * * *